US006190053B1

(12) United States Patent
Stahlecker et al.

(10) Patent No.: US 6,190,053 B1
(45) Date of Patent: Feb. 20, 2001

(54) STEP BEARING HOUSING FOR AN OPEN-END SPINNING ROTOR SHAFT AND METHOD OF OPERATING SAME

(75) Inventors: Gerd Stahlecker, Eislingen Fils; Friedbert Schmid, Bad Ueberkingen, both of (DE)

(73) Assignee: Novibra GmbH, Suessen (DE)

( * ) Notice: Under 35 U.S.C. 154(b), the term of this patent shall be extended for 0 days.

(21) Appl. No.: 09/270,743

(22) Filed: Mar. 16, 1999

(30) Foreign Application Priority Data

Apr. 22, 1998 (DE) ..... 198 17 911

(51) Int. Cl.[7] ..... F16C 19/50
(52) U.S. Cl. ..... 384/610
(58) Field of Search ..... 384/606, 610, 384/471, 466; 57/404, 400

(56) References Cited

U.S. PATENT DOCUMENTS 3,231,317 * 1/1966 Dudar ..... 384/461 X
4,618,273 10/1986 Goetz et al. .
4,758,100 * 7/1988 Guttinger ..... 384/399
5,173,797 * 12/1992 Zedekar et al. ..... 384/123 X
5,487,612 * 1/1996 Anderson ..... 384/610 X
5,927,869 * 7/1999 Zott ..... 384/610
6,017,152 * 1/2000 Ogawa et al. ..... 384/466
6,032,452 * 3/2000 Zott ..... 384/610 X

* cited by examiner

*Primary Examiner*—Sherry Estremsky
(74) *Attorney, Agent, or Firm*—Evenson, McKeown, Edwards & Lenahan, P.L.L.C.

(57) ABSTRACT

A step bearing is provided to axially support a shaft of an open-end spinning rotor, having a step bearing housing with a freely rotatable supporting ball, against which the end of the shaft is supported. The step bearing housing has a take-up space in the form of a lubricating grease reservoir in which the supporting ball is located. A lubricant distributor is arranged at the take-up space and is movable relative thereto.

27 Claims, 4 Drawing Sheets

220
222
206
207
221
8
10
13
9
15
1
A
16
4
11
2
12
3

320
322
324
306
321
8
13
307
325
9
16
10
11
2
3
15

STEP BEARING HOUSING FOR AN OPEN-END SPINNING ROTOR SHAFT AND METHOD OF OPERATING SAME

BACKGROUND AND SUMMARY OF THE INVENTION

This application claims the priority of German application 198 17 911.1, filed Apr. 22, 1998, the disclosure of which is expressly incorporated by reference herein.

The present invention relates to a step bearing having a housing comprising a take-up in the form of a lubricating grease reservoir for taking up a freely rotatable supporting ball, and a front end supporting surface of a shaft of an open-end spinning rotor. The shaft is loaded with an axial force and the supporting surface is disposable on the supporting ball. The step bearing housing also accommodates thrust bearing supporting the supporting ball.

Lubricating the supporting ball with grease instead of oil brings with it the essential advantage that the machine does not become covered in oil and thus remains cleaner. The grease lubrication, however, must be designed in a very particular way, so that an equally good operational efficiency is achieved as with an oil supporting ball.

A step bearing housing comprising a take-up space in the form of a lubricating grease reservoir for a supporting ball is known from U.S. Pat. No. 4,618,273. The lubricating grease reservoir is relatively large here, so that it can be assumed that in the case of an increase in heat, a flowing motion arises, even if it is a slow one, by means of which the lubrication of the supporting ball is permitted. A collector for used lubricating grease is arranged at the take-up area for lubricating grease. When the supply of lubricating grease is used up, a new supply of lubricating grease can be applied to the take-up with the aid of a correspondingly formed lubricating grease press.

It has been shown that, up to the present, dependent on the amount of used lubricating grease, sometimes no grease reaches the critical place between the supporting surface of the shaft and the supporting ball. When the grease in direct proximity to the supporting ball is used up, when it contains hardly any more oil, it can happen that there is insufficient lubrication, namely principally in the case of relatively small lubricating grease reservoirs, in which there is not enough new, unused grease being pressed through. Also, used lubricating grease is not always removed efficiently enough.

It is an object of the present invention to avoid these disadvantages and to design a step bearing housing, in which lubricating grease can be applied at the right time, and without a complicated procedure, to the critical places of the supporting ball, while at the same time removing the used lubricating grease from these same places.

This object has been achieved according to the present invention in that a lubricant distributor, operated from the outside, is arranged at the take-up and is movable relative thereto.

When means are provided to set the lubricating grease reservoir in motion after a certain running time, then a small lubricating grease reservoir is sufficient which is small and handy and can be applied to the machine in exchange without any great disassembly taking place. This lubricant distributor can be operated from the outside at certain maintenance intervals by an operator, without the step bearing housing being disassembled, by means of a simple handle or a suitable tool. Thus the lubricating grease is "stirred", whereby used lubricating grease is removed from the old place and new lubricating grease is applied again to the supporting ball.

The present invention is based on the knowledge that after even a long running time of the step bearing, only a very small percent of the grease is actually used. Most of the grease filling is, for lubricating purposes, new and completely usable. When the grease is stirred from time to time, the lubricating of the supporting ball is ensured.

In the simplest embodiment of the present invention, the lubricant distributor can be designed as an adjustable closing piece, thus reducing the size of the take-up. Such a closing piece, which can, for example, form the closing lid of the take-up, can be screwed lower into the take-up by means of a screw thread for the purpose of subsequent lubrication, or it can be pressed in from time to time further into the take-up by means of a clip connection or the like. When re-adjusting, new grease is pressed onto the critical place and the used grease is pressed out.

The closing piece can, for example, take the form of a locking ball. According to the number of notches provided, the grease in the lubricating grease reservoir can be made to circulate several times.

It is practical for the purposes of the present invention when the closing piece is provided with a hollow which enlarges the take-up. The closing piece has then, for example, the shape of a hat, whose inner hollow space is a component of the take-up. By pressing the closing piece down, the grease located in close proximity to the supporting ball is displaced by means of pressing out. The excess grease enters an outer chamber, where it does no damage.

The described methods have the advantage in that the operating personnel do not have to work with a grease press, where, in the case of carelessness, it can happen that too much grease is applied and grease thus gets into parts where it is not required.

In an advantageous embodiment of the present invention, the lubricating grease reservoir is designed as an insert turnable in relation to the take-up. When, after a pre-determined running time, the grease supply to the supporting ball is to be secured again, the operating personnel are instructed to turn the insert by a pre-determined amount relative to the step bearing housing, or alternatively in the case of a stationarily arranged insert, to turn the step bearing housing relative thereto. This results in a kind of twirling effect. This can be increased in that the insert has a wing-like form, whereby the wings extend somewhat slanted, so that a screw effect arises. If the insert is turned too much, no damage is done, as the amount of grease in the inside of the lubricating grease reservoir does not change. In addition, no grease is released outside which might make keeping the machine clean difficult. The purpose of the insert is to make full use of the lubricating grease located in the take-up. This permits a reliable lubrication without grease re-fill occurring too quickly.

For the purpose of the present invention, the insert, or the step bearing housing movable relative thereto, is provided with working surfaces for a tool.

The insert can be applied in different ways in the step bearing housing. In one embodiment according to the present invention, it is possible to apply the insert to the step bearing housing from the side of the thrust bearing. In another embodiment according to the present invention, the insert is applied to the step bearing housing from the side of the shaft of the open-end spinning rotor.

The insert can be so designed that it borders the take-up with a radial web. An opening for the shaft can be provided in the web, whereby a non-contact seal is provided. When the end of the shaft is accordingly graduated, a labyrinth seal can thus be formed in this way.

In a particularly advantageous embodiment of the present invention, it is provided that the insert comprises finger-like turnable wings surrounding the supporting ball at a distance, the axis of which turnable wings,lies coaxial to the shaft. Because of the turning of the turnable wings, the grease is forced to escape, and is pressed unavoidably towards the critical point of the supporting ball. By means of the small distance to the supporting ball, the turnable wings can at the same time form a securing device so that when the shaft of the open-end spinning rotor is pulled out, the supporting ball essentially holds its operational position and returns to its operational position after the shaft is guided in again.

It is particularly favorable when stationarily arranged stopping ribs are arranged at the turnable wings. These ribs can, for example, project radially inwardly from a hollow cylindrical peripheral wall of the take-up, and the turnable wings can be movable between the stopping ribs. When the turnable ribs push against a stopping rib, this is a signal for the operator that the turnable wings must be turned in the other direction for the next lubrication. The turnable wing is always turned in that direction which is currently possible.

The stopping ribs can also surround the supporting ball at a short distance thereto, so that they also function as a support when the shaft of the open-end spinning rotor is removed.

A collector for lubricating grease can be arranged at the takeup. Thus used grease, which has to a great extent become liquid, flows from the take-up to the collector. Thus, when the grease is "stirred" by means of the lubricant distributor, the lubricating grease always reaches only those parts where it is either needed or where it does no damage. Additionally it can be provided that the take-up is separated from the collector by the insert itself.

In a further, particularly advantageous embodiment of the present invention, the step bearing housing takes the form of a cartridge, which forms, together with the supporting ball, an exchangeable spare part. Thus the possibility is retained, when the lubricating grease is finally used up, to exchange the cartridge for a cartridge with new lubricating grease. This exchange takes place infrequently due to the activity of the lubricant distributor according to the present invention. However, when the exchange must eventually take place, it is very simple to execute. The work involved and subsequently the costs for relubricating a step bearing are considerably reduced. In place of the removed cartridge, a new cartridge with the necessary supply of lubricating grease and a new supporting ball is applied. By activating the lubricant distributor between two cartridge exchange periods, the time intervals for exchanging a cartridge are significantly reduced.

BRIEF DESCRIPTION OF THE DRAWINGS

These and further objects, features and advantages of the present invention will become more readily apparent from the following detailed description thereof when taken in conjunction with the accompanying drawings wherein.

DETAILED DESCRIPTION OF THE DRAWINGS

The step bearing shown in FIGS. 1 to 7 is a component of an open-end spinning arrangement (not shown), which comprises a spinning rotor having a shaft 1 and a rotor cup (not shown). The shaft 1 is supported in a radial bearing in a way not shown, which radial bearing is designed as a so-called supporting disc bearing. Such a supporting disc bearing comprises in a known way four supporting discs arranged in pairs, whereby each pair of these supporting discs forms a wedge-shaped gap in which the shaft 1 is disposed. By means of suitable measures, in particular a slight slanting of the axes of the supporting disc pairs, an axial force A is exerted to the end of the shaft 1. The step bearing serves to take up the axial forces of the horizontally arranged shaft 1, which step bearing comprises a freely rotatable supporting ball 2 and a thrust bearing 3, which comprises a concave surface matching to the supporting ball 2. In operational position of the spinning rotor, the shaft 1 is supported with a front end supporting surface 4 on the supporting ball 2 and presses this into the concave take-up surface of the thrust bearing 3.

Figure 1:
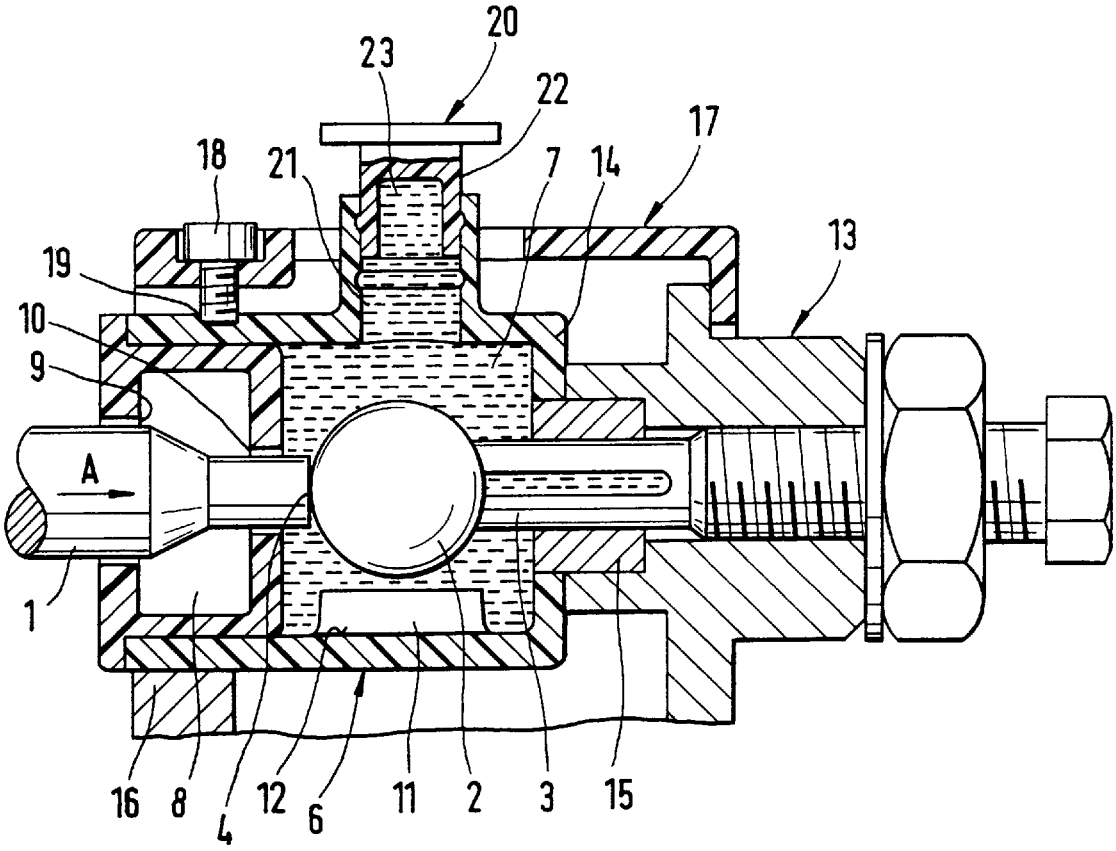
FIG. 1 is a longitudinal sectional view of a step bearing comprising a step bearing housing according to the present invention, to which an adjustable closing piece as a lubricant distributor is arranged.

The step bearing according to FIG. 1 comprises a step bearing housing 6, which is made of plastic and which has essentially a cylindrical shape. The step bearing housing 6 is divided into two inner spaces, namely into a take-up 7 for lubricating grease and a collector 8. The latter is directly adjacent to the former and serves to collect grease which exits from the take-up 7.

The shaft 1 projects with its end through the collector 8, whereby the section containing the front end supporting surface 4 projects into the take-up 7. The collector 8 comprises two openings 9 and 10 disposed opposite one another, through which the shaft 1 is placed. The openings 9 and 10 are sealed in a non-contact way against the shaft 1. The take-up 7 has a plurality of ribs 11, which project radially inwards from the hollow cylindrical peripheral wall 12 of the take-up 7 and which surround the supporting ball 2 at a short distance therefrom. When the shaft 1 is withdrawn from the take-up 7 in opposite direction to the direction of the axial force A, the supporting ball 2 falls out of the concave take-up of the thrust bearing 3 and is disposed onto one of the ribs 11 arranged underneath. The take-up 7 is divided into divisional sections by means of the ribs 11, which sections surround the supporting ball 2 and are filled with a supply of lubricating grease.

The step bearing housing 6 is affixed in a removable way to a stationary holding device 13, which is connected in a way not shown with a frame of the open-end spinning arrangement. The thrust bearing 3 is designed as an axially adjustable, tuning fork-like pin, which projects a little way into the take-up 7 through the bottom 14 of the step bearing housing 6. When the pin is turned, the axial position of the thrust bearing 3, and thus also the supporting ball 2, can be adjusted.

The flexibly formed bottom 14 of the step bearing housing 6 is provided with a cylindrical opening, whose diameter is slightly smaller than that of the outer diameter of a bearing bush 15 of the thrust bearing 3. The step bearing housing 6 is slid with its bottom 14 a little way onto the bush bearing 15, whereby a relatively affixed, but movable close sliding fit between the bottom 14 and the bush bearing 15 is created. When the pin is turned, its axial position alters and also that of the thrust bearing 3, independent of the position of the step bearing housing 6.

In the area below the shaft 1, the holding device 13 forms a shell 16, on which the step bearing housing 6 is disposed. The position of the step bearing housing 6 is in addition fixed by means of a lid 17, which is affixed to the holding device 13 and engages by means of a screw 18 in a recess 19 of the step bearing housing 6.

When the supply of lubricating grease is used up, the step bearing housing 6 is replaced by another one. After the screw 18 has been released, the lid 17 is firstly removed. The step bearing housing 6, together with the supporting ball 2, can be pulled out forwards, that is, in the opposite direction to the axial force A. The bottom 14 is hereby released from its close sliding fit with the bearing bush 15. The thrust bearing 3 remains unchanged in its set position.

After the step bearing housing 6 has been removed, another step bearing housing 6, which comprises a supporting ball and which is provided with the necessary supply of lubricating grease, is assembled. This takes place in reverse order of the removal of the old step bearing housing 6. The new step bearing housing is slid onto the bush bearing 15 in the area of its bottom, whereby an exact positioning of the new step bearing housing is not necessary. After the exchange of the step bearing housing 6, the old position of the thrust bearing 3 remains unchanged, whereby the newly assembled supporting ball attains a position which corresponds to the position of the removed supporting ball 2.

After the new step bearing housing has been slid onto the bush bearing 15, the lid 17 is again affixed to the holding device 13, whereby the screw 18 is disposed in a relevant recess of the new step bearing housing.

In order to delay the exchange of a step bearing housing 6 for a new one with new lubricating grease for as long as possible, a lubricant distributor 20 is arranged according to the present invention to the take-up 7 and is movable relative thereto, the lubricant distributor 20 being activated from the outside.

The step bearing housing 6 comprises a chimney-like opening 21. In it is disposed an adjustable closing piece 22, whose upper position is shown. This position is secured in this case by a clip. The closing piece 22 comprises a scarcely accentuated annular ring, which engages in the manner of a clip into a corresponding recess of the flexible chimney-like opening 21.

The closing piece 22 has a hollow space 23 on its side facing the take-up 7, which thus enlarges the take-up 7. The hollow space 23 is also filled with lubricating grease.

When, after a pre-determined running time of the open-end spinning rotor, the grease supply is to be secured again, the closing piece 22 is pressed downwards by the operating personnel, namely in the lower notch position. The lubricating grease located near the supporting ball 2 is hereby displaced. Part of the excess grease can exit through the opening 10 into the collector 8. Here it does no damage. By activating the closing piece 22, new lubricating grease definitely reaches the critical point between the supporting surface 4 and the supporting ball 2 as well as between the thrust bearing 3 and the supporting ball The chimney-like opening 21 can be provided with additional notch steps according to other contemplated embodiments, whereby then, for example, the closing piece 22 is placed a step lower each year.

In the FIGS. 2 to 7 described below, components having the same functions have the same reference numbers as in FIG. 1, so that a repeat description is omitted. Reference is hereto made to FIG. 1.

Figure 2:
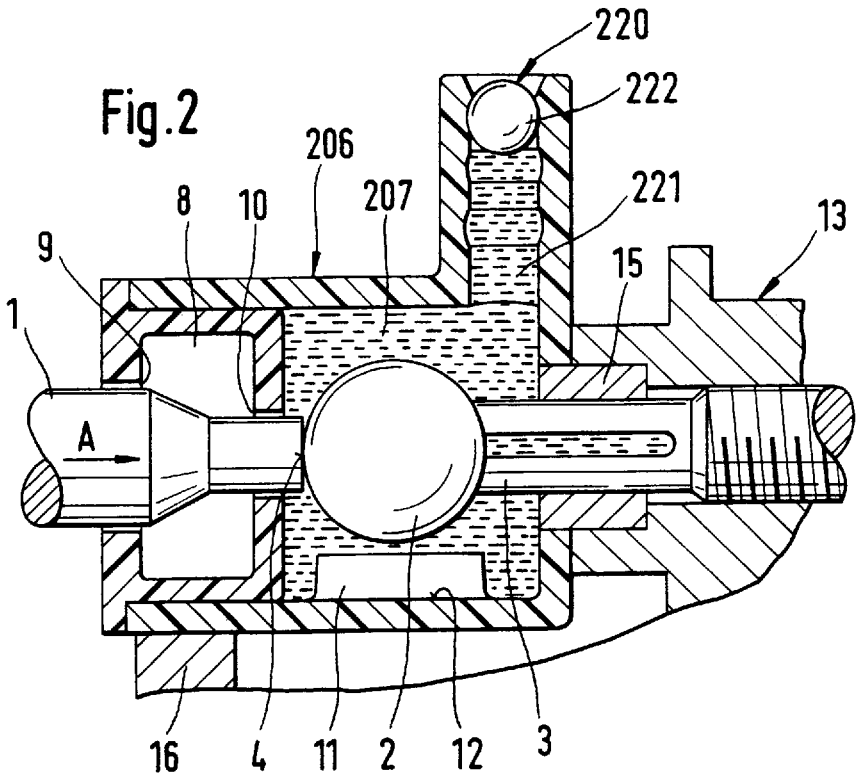
FIG. 2 is a view similar to FIG. 1, showing another embodiment of the invention, wherein a locking ball is provided as a closing piece.
Figure 3:
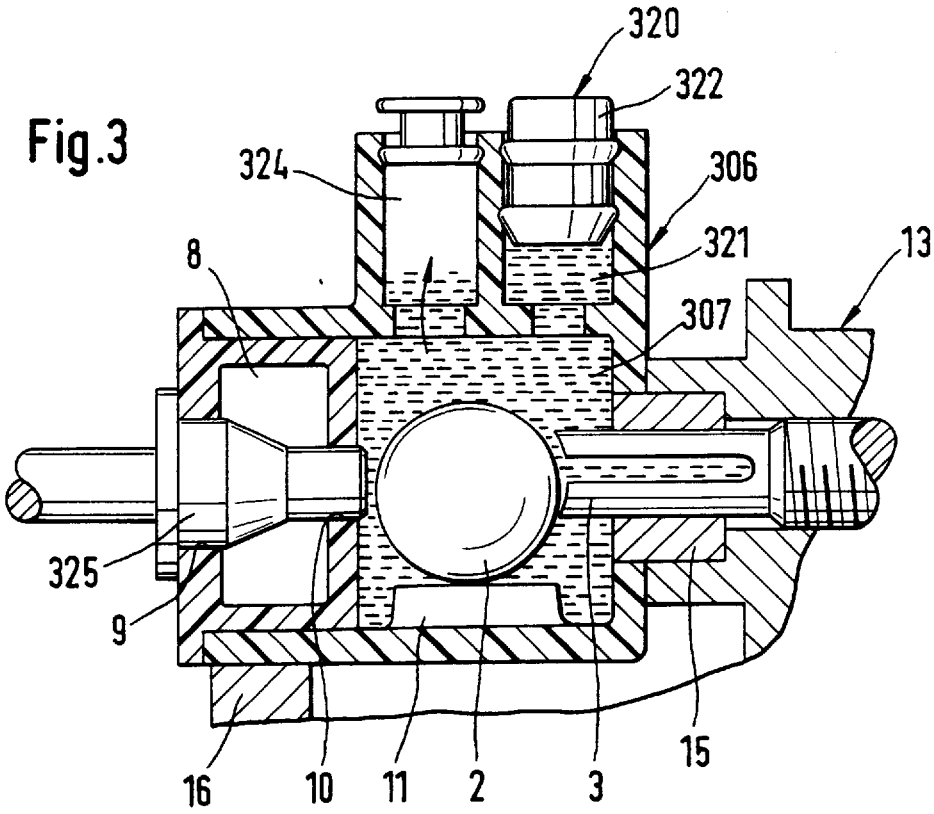
FIG. 3 is a view similar to FIGS. 1 and 2, showing another embodiment of the invention, wherein an empty space for pressed-through lubricating grease is arranged at the closing piece.

In the embodiment of the present invention according to FIG. 2, a somewhat differently designed step bearing housing 206 to the one in FIG. 1 is shown. The step bearing housing 206 again has a chimney-like opening 221, to which a lubricant distributor 220 in the form of a closing piece 222 is arranged. This closing piece 222 is, in the present case, designed as an adjustable notch ball. In order to re-grease, the closing piece 22 is pressed downwards, until it locks into the next recess of the chimney-like opening 221. This also permits the lubricating grease to reach the critical points of the supporting ball 2. Excess lubricating grease can enter the collector 8 through the opening 10.

The step bearing housing 306 according to FIG. 3 is again differently designed, whereby an empty space 324 is now provided adjacently to the chimney-like opening 321. When the closing piece 322 of the lubricant distributor 320 is pressed downwards, the lubricating grease is spread around the supporting ball 2, and the excess lubricating grease reaches the empty space 324. Thus excessive pressure in the take-up 307 during re-lubrication is avoided.

In this embodiment of the present invention, while the closing piece 322 is being pressed down, the shaft 1 of the open-end spinning rotor is removed and replaced by a closing tool 325, which exactly closes the openings 9 and 10. The closing tool 325 is advantageously made of plastic, so that the step bearing housing 306, which is also made of plastic, is not damaged. Due to the tight closing of the openings 9 and 10, the displaced lubricating grease is forced to enter the empty space 324, where it does no damage. Only during operation, that is, when the shaft 1 of the open-end spinning rotor is in place, can excess grease flow into the collector 8.

Figure 4:
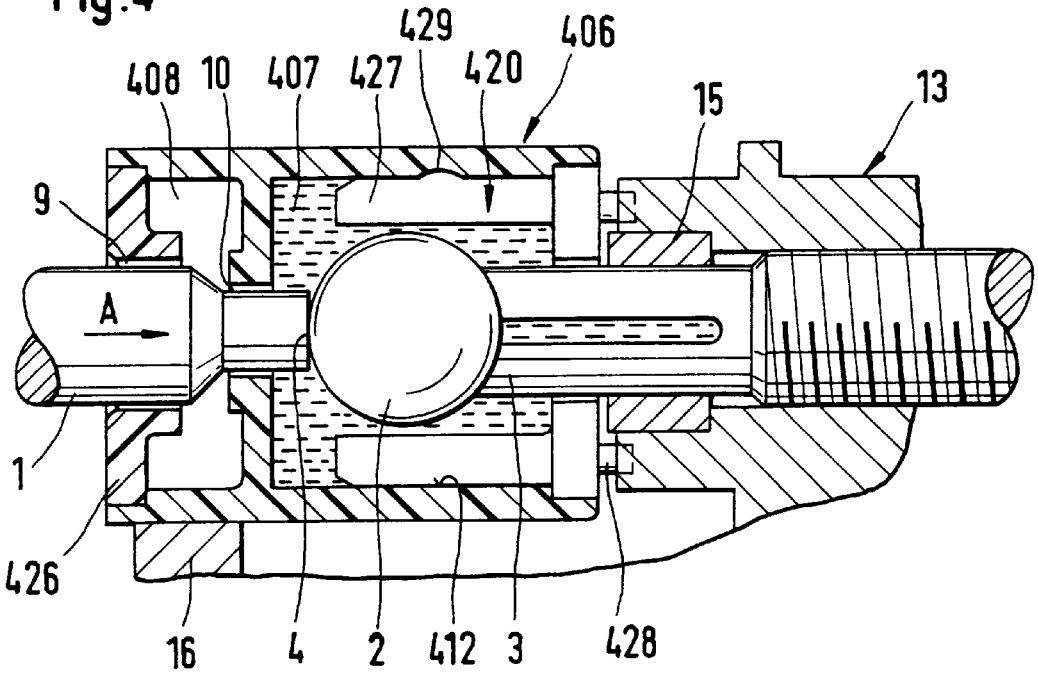
FIG. 4 is a longitudinal sectional view of a step bearing housing according to another preferred embodiment of the present invention, comprising as a lubricant distributor an insert, relative to which the step bearing housing is rotatable.
Figure 5:
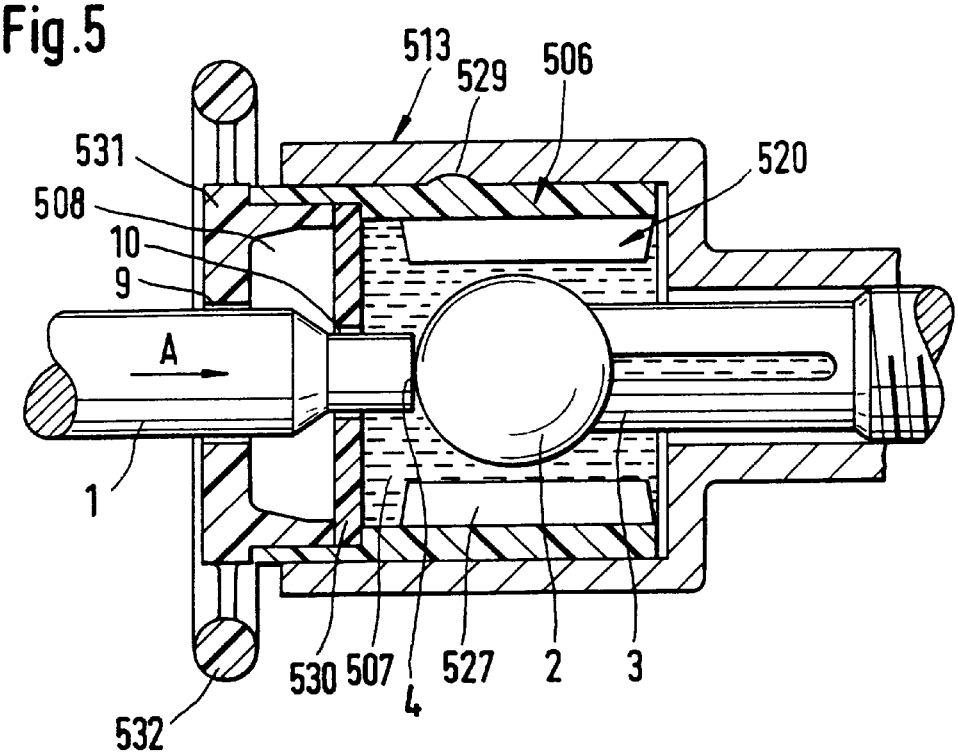
FIG. 5 is a longitudinal sectional view of an embodiment according to the present invention similar to FIG. 4, whereby the insert is activated by means of a handwheel.

In the embodiment according to FIG. 4, the step bearing housing 406 is designed as a cylindrical cartridge. It contains again a take-up 407, and a collector 408 injection-molded onto the step bearing housing 406, which collector 408 is covered by a separate cover 426 in this embodiment of the present invention.

The lubricant distributor 420 is in this embodiment of the present invention designed as a lamella-like insert 427, which is applied to the step bearing housing 406 from the side of the thrust bearing 3. The insert 427 is stationarily affixed in relation to the holding device 13 of the frame by means of a centering 428. The step bearing housing 406 is secured relative to the insert 427 by at least one notch 429.

In this embodiment of the present invention, it is not the insert 427 that is turned, but rather the step bearing housing 406, whereby, however, the take-up 407 is moved relatively in relation to the lubricant distributor 420. When the step bearing housing 406 is turned, a type of whirling effect arises. This may be increased in that the lamellas of the insert 426 extend somewhat diagonally, so that a screw effect arises.

The lubricating reservoir can be fully utilized due to the turning device. A reliable lubrication without premature grease re-fill is ensured.

The step bearing housing 506 according to FIG. 5 is again divided into a take-up 507 and a collector 508. The step bearing housing 506 is supported here in a holding device 513, which takes the form of a tube-like housing and which supports the thrust bearing 3 at the same time.

The lubricant distributor 520 is designed as a wing-like insert 527 in this embodiment of the present invention, which projects out from the inner peripheral wall of the step bearing housing 506 and is turnable with the step bearing housing 506. As the thrust bearing 3 is supported stationarily, there exists here also a relative movement between the lubricant distributor 520 and the take-up 507, that is, the lubricating grease is stirred.

The wing-like insert 527, at a distance from the supporting ball 2, serves as a securing stopper when the shaft 1 is pulled out.

The turnable insert 527 comprises for the bore hole 10 a separately insertable sealing disc 530. The front part 531, which comprises the other bore hole 9, is, for production reasons, not made in one single piece with either the sealing disc 530 nor with the step bearing housing 506. The front part 531 is pressed into the step bearing housing 506 and secures the sealing disc 530 in this way. During normal operation, the step bearing housing 506 is secured by means of a notch 529 against the holding device 513.

When, after a predetermined running time, the lubricant supply of the supporting ball 2 has to be renewed, the operating personnel are advised to turn the step bearing housing 506 by means of a handwheel 532 by a predetermined amount.

Figure 6:
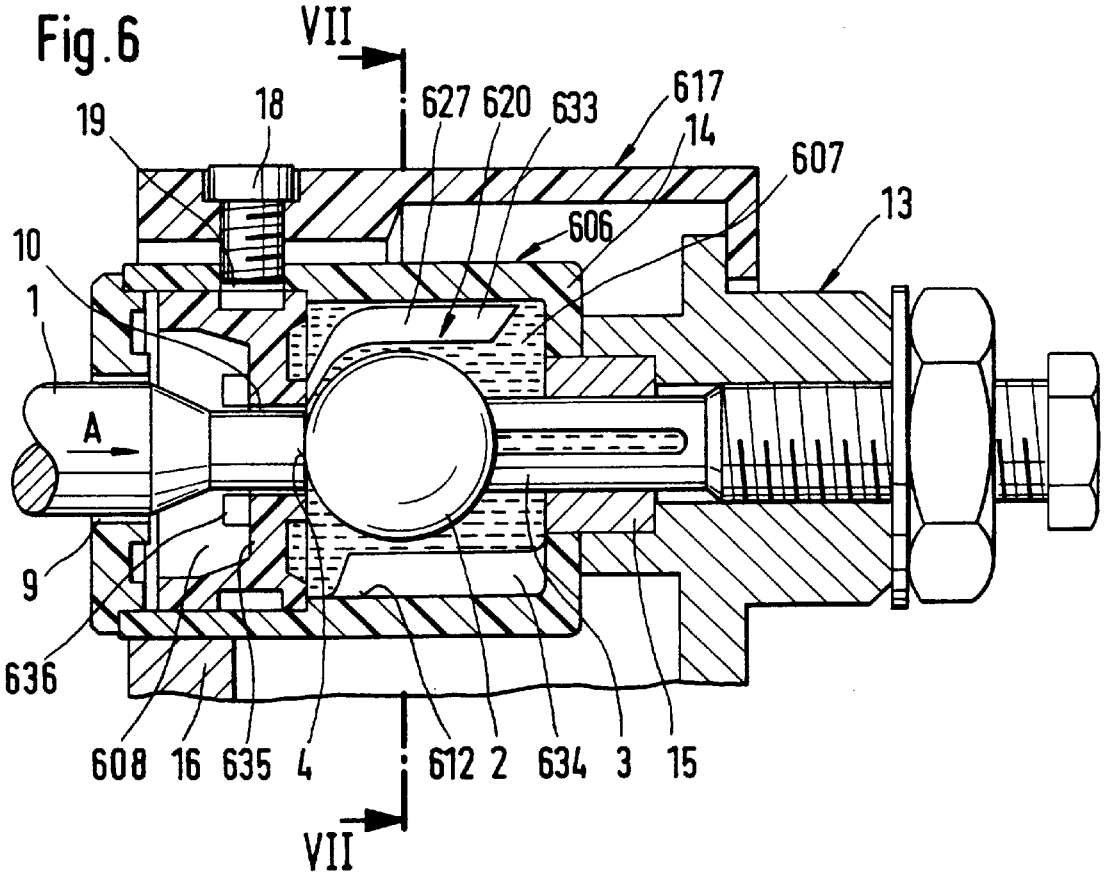
FIG. 6 is a longitudinal sectional view of an embodiment according to the present invention in which the insert takes the form of turnable wings turnable inside the step bearing housing.
Figure 7:
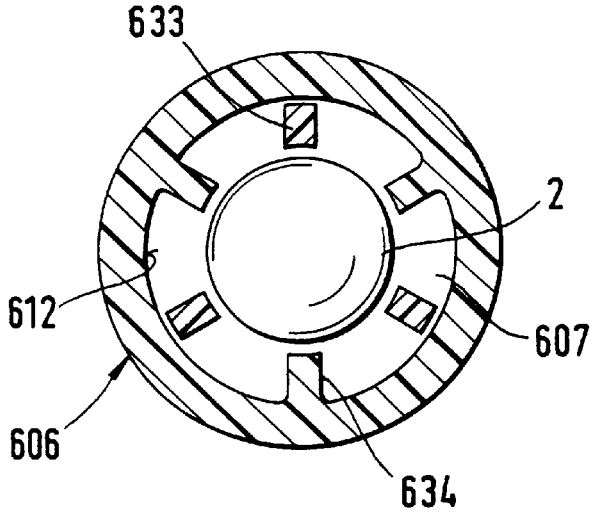
FIG. 7 is a sectional view of the step bearing housing along the intersecting surface VII—VII of FIG. 6.

A particularly advantageous embodiment of the present invention is shown in FIGS. 6 and 7. The step bearing housing 606 is again recognizable, which comprises a take-up 607 and a collector 608. It is ensured by means of a lid 617 to the holding device 13.

The lubricant distributor 620 has in this case a plurality, here three, turnable wings 633, which are supported in the step bearing housing 606 as an insert 627 and which are turnable in relation thereto. The turnable wings 633 surround, finger-like, the supporting ball 2 at a distance thereto. The axis of the turnable wings 633 lies coaxially to the shaft 1.

In addition, there are a plurality, in this case also three, stopping ribs 634 in the take-up 607, which stopping ribs 634 project radially inwards from the peripheral wall 612 of the step bearing housing 606, and which are arranged to the individual turnable wings 633. The turnable wings 633 can thus move from side to side between the stopping ribs 634, when they are activated by operating personnel from the outside.

The insert 627 has a radial web 635, which separates the take-up 607 from the collector 608. The web 635 has engaging surfaces 636 for a tool (not shown) which is advantageously then applied, when the shaft 1 of the open-end spinning rotor is removed beforehand.

By turning the turnable wings 633 between the stopping ribs 634, unused lubricant is fed to the critical point between the supporting ball 2 and the supporting surface 4 as well as the other critical point between the supporting ball 2 and the thrust bearing 3. Irrespective in which direction the insert 627 is turned, the lubricant is forced by pressing into the center. It is thus pressed towards the supporting ball 2. When during turning a turnable wing 633 pushes against a stopping rib 634, this is a signal for the operating personnel to turn towards the other side the next time.

The insert 627, whose turnable wings 633 project into the take-up 607, is slidably guided outside of the take-up 607 on a cylindrical inner wall of the step bearing housing 606.

The embodiment of the present invention as shown in FIGS. 6 and 7 is particularly suitable for forming the step bearing housing 606, including the supporting ball 2, as a disposable component in the form of an exchangeable cartridge.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A step bearing assembly comprising:

a housing, and a lubricating grease reservoir in the housing accommodating a rotatable supporting ball and an end of shaft of an open-end spinning rotor, wherein said reservoir is provided with a movable lubricant distributor, which is activatable from outside of the housing.

2. A step bearing assembly according to claim 1, wherein the lubricant distributor takes the form of an adjustable closing piece, which when adjusted reduces the reservoir volume.

3. A step bearing assembly according to claim 2, wherein the closing piece is designed as a notch ball.

4. A step bearing assembly according to claim 2, wherein the closing piece is provided with a hollow space which enlarges the reservoir volume.

5. A step bearing assembly according to claim 1, wherein the lubricant distributor is designed as an insert turnable in relation to the reservoir.

6. A step bearing assembly according to claim 5, wherein the insert is provided with engaging surfaces for a tool.

7. A step bearing assembly according to claim 6, wherein the insert comprises finger-like turnable wings which surround the supporting ball at a distance, the axis of the turnable wings being coaxial to the shaft.

8. A step bearing assembly according to claim 5, wherein the insert is operable from a thrust bearing side of the housing.

9. A step bearing assembly according to claim 8, wherein the insert has a radial web which defines the boundary of the reservoir and comprises a sealed opening for the shaft.

10. A step bearing assembly according to claim 8, wherein the insert comprises finger-like turnable wings which surround the supporting ball at a distance, the axis of the turnable wings being coaxial to the shaft.

11. A step bearing housing according to claim 5, wherein the insert is operable from a shaft side of the housing.

12. A step bearing assembly according to claim 11, wherein the insert comprises finger-like turnable wings which surround the supporting ball at a distance, the axis of the turnable wings being coaxial to the shaft.

13. A step bearing assembly according to claim 5, wherein the insert comprises finger-like turnable wings which surround the supporting ball at a distance, the axis of the turnable wings being coaxial to the shaft.

14. A step bearing assembly according to claim 13, wherein stopping ribs are arranged stationarily with respect to the turnable wings.

15. A step bearing assembly according to claim 14, wherein the stopping ribs surround the supporting ball at a short distance therefrom and project inwards from a hollow cylindrical peripheral wall of the reservoir.

16. A step bearing assembly according to claim 1, wherein the reservoir is connected with a collector for lubricating grease.

17. A step bearing housing according to claim 16, wherein the reservoir is separated from the collector by means of a turnable insert forming part of the lubricant distributor.

18. A step bearing assembly according to claim 1, wherein the reservoir is designed as a cartridge, which, together with the supporting ball, forms an exchangeable part.

19. A step bearing for axially supporting a spinning rotor shaft, comprising:

a rotatable supporting ball engageable in use against a rotor shaft end, a lubricating grease reservoir enclosing the supporting ball and a supply of lubricating grease for lubricating the ball and rotor shaft end contacting surfaces, and a lubricant distributor operable to impart stirring movement to the lubricating grease within the reservoir.

20. A step bearing according to claim 19, wherein said lubricant distributor includes at least one lubricating grease stirring member manually operably movable from outside the reservoir without requiring disassembly of a housing containing the reservoir.

21. A step bearing according to claim 20, wherein said lubricant distributor includes a manually engageable handwheel.

22. A step bearing according to claim 20, wherein said lubricant distributor includes a hand tool operable member.

23. A step bearing according to claim 20, wherein the at least one lubricating grease stirring member includes a movable plug operable to decrease the volume of the reservoir by pressing on the lubricating grease in the reservoir.

24. A step bearing according to claim 23, wherein the movable plug is a stepped cylindrical plug disposed in a chimney opening to the reservoir.

25. A step bearing according to claim 23, wherein the movable plug is a ball movable between stepped detents in a chimney opening to the reservoir.

26. A step bearing according to claim 20, wherein the at least one lubricating grease stirring member includes a plurality of stirring vanes disposed around the ball.

27. A method of operating a step bearing for axially supporting a spinning rotor shaft, which step bearing includes:

a rotatable supporting ball engageable in use against a rotor shaft end; and a lubricating grease reservoir surrounding the supporting ball and rotor shaft end, said method comprising:

filling the reservoir with grease, and subsequent to a period of time running a spinning assembly with rotation of the rotor shaft, applying a lubricant shifting motion to the grease in the reservoir to thereby introduce substantially unused grease to said ball and rotor shaft end without requiring resupply of grease to the reservoir, wherein said applying a shifting motion to the grease in the reservoir includes manually moving a grease stirring member from outside the grease reservoir without requiring disassembly of a housing containing the reservoir.

* * * * *